US008382955B2

(12) United States Patent
Häussler et al.

(10) Patent No.: US 8,382,955 B2
(45) Date of Patent: Feb. 26, 2013

(54) METHOD FOR OPERATING A SHEET-FORMING UNIT, AND SHEET FORMING UNIT

(75) Inventors: Markus Häussler, Herbrechtingen (DE); Hans Loser, Langenau (DE); Volker Schmidt-Rohr, Heidenheim (DE); Wolfgang Ruf, Herbrechtingen (DE); Thomas Ruehl, Wernau (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/370,697

(22) Filed: Feb. 10, 2012

(65) Prior Publication Data

US 2012/0193059 A1 Aug. 2, 2012

Related U.S. Application Data

(63) Continuation of application No. PCT/EP2010/056308, filed on May 10, 2010.

(30) Foreign Application Priority Data

Aug. 10, 2009 (DE) ..... 10 2009 028 385

(51) Int. Cl.
*D21F 1/18* (2006.01)

(52) U.S. Cl. ..... 162/341

(58) Field of Classification Search ..... 162/341, 162/343, 336

See application file for complete search history.

(56) References Cited

U.S. PATENT DOCUMENTS

| | | | |
|---|---|---|---|
| 7,067,040 | B2 | 6/2006 | Lepomaki et al. |
| 2003/0178167 | A1 | 9/2003 | Fujiki et al. |

FOREIGN PATENT DOCUMENTS

| | | | |
|---|---|---|---|
| DE | 297 13 433 | U1 | 10/1997 |
| DE | 199 02 621 | A1 | 7/2000 |
| DE | 199 37 302 | A1 | 2/2001 |
| DE | 101 06 684 | A1 | 8/2002 |
| DE | 102 30 301 | A1 | 4/2003 |
| DE | 102 34 559 | A1 | 2/2004 |
| EP | 1 022 378 | A2 | 7/2000 |
| EP | 1 313 912 | B1 | 5/2007 |
| WO | 2008/077585 | A1 | 7/2008 |

OTHER PUBLICATIONS

English translation of International Search Report dated Oct. 19, 2010 for PCT/EP2010/056308 (2 pages).
English translation of International Preliminary Report on Patentability dated Mar. 6, 2012 for PCT/EP2010/056308 (12 pages).
English translation of Written Opinion of the International Searching Authority (undated) for PCT/EP2010/056308 (11 pages), Feb. 2012.

(Continued)

*Primary Examiner* — Mark Halpern
(74) *Attorney, Agent, or Firm* — Taylor IP, P.C.

(57) ABSTRACT

A method for operating a sheet-forming unit of a papermaking machine. At least one fibrous material suspension is fed to a headbox and is conducted in a plurality of turbulence-generating channels to form sub-flows, and fed to a nozzle. From the nozzle, the at least one fibrous material suspension is in the form of a free jet into the forming unit to define an impingement line. In a final fluidization region of an individual turbulence-generating channel a pressure loss (Δp) of ≧50 mbar is generated within the fibrous material suspension before inlet thereof into the nozzle, and the fibrous material suspension is guided from the final fluidization region as far as the impingement line in such a way that the dwell time of the suspension in the region defined by the final fluidization region as far as the impingement line ranges from >30 ms to ≦300 ms.

17 Claims, 6 Drawing Sheets

OTHER PUBLICATIONS

English translation of International Search Report dated Oct. 18, 2010 for PCT/EP2010/056309 (2 pages).

English translation of International Preliminary Report on Patentability dated Feb. 14, 2012 for PCT/EP2010/056309 (13 pages).

English translation of Written Opinion of the International Searching Authority (undated) for PCT/EP2010/056309 (12 pages), Feb. 2012.

International Search Report dated Oct. 5, 2010 for International Application No. PCT/EP2010/056308 (4 pages).

FIG. 4A1
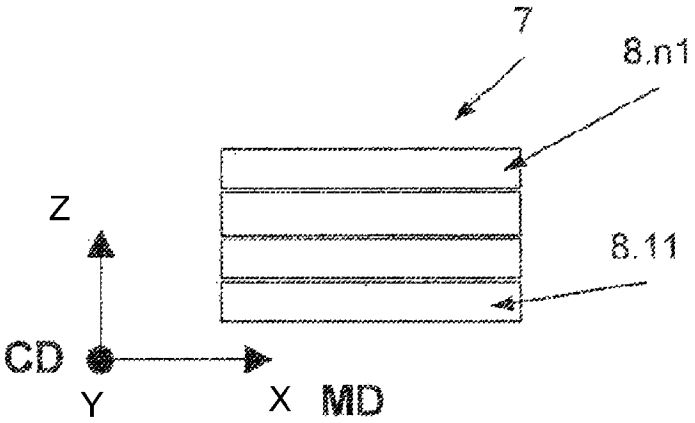
FIG. 4A2
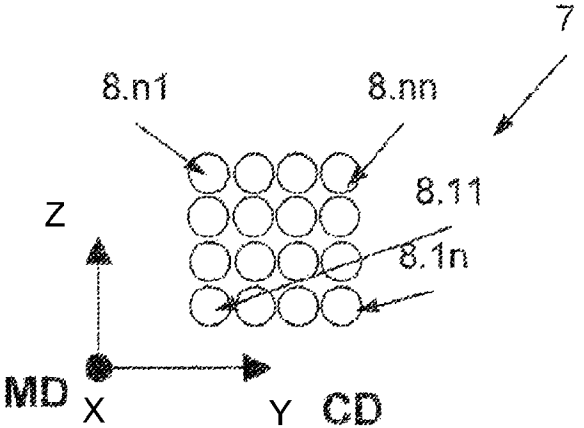
FIG. 4B1
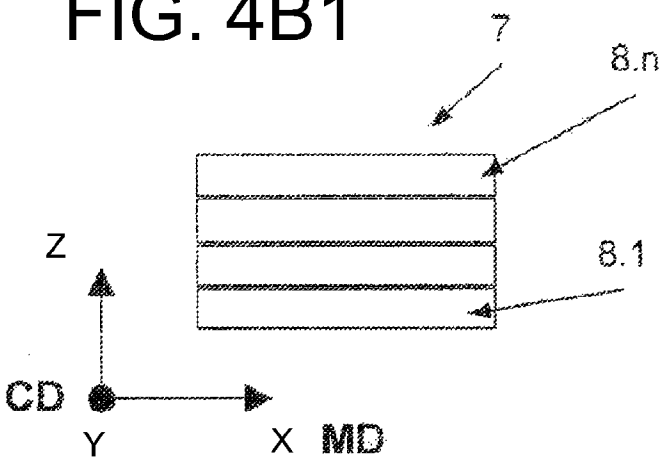
FIG. 4B2
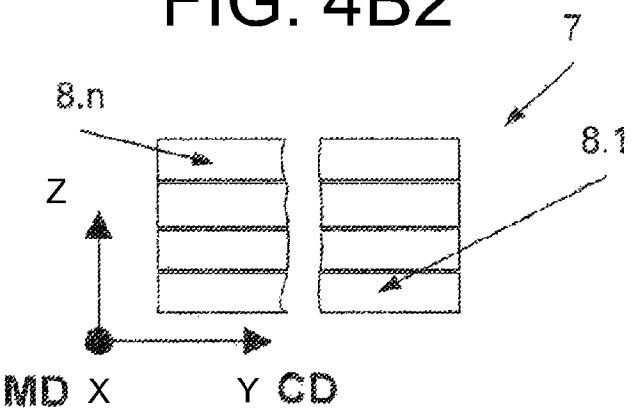

METHOD FOR OPERATING A SHEET-FORMING UNIT, AND SHEET FORMING UNIT

CROSS REFERENCE TO RELATED APPLICATIONS

This is a continuation of PCT application No. PCT/EP2010/056308, entitled "METHOD FOR OPERATING A SHEET-FORMING UNIT, AND SHEET-FORMING UNIT", filed May 10, 2010, which is incorporated herein by reference.

BACKGROUND OF THE INVENTION

1. Field of the Invention

The invention relates to a method for operating a sheet forming unit for a machine for producing fibrous webs, in particular paper, cardboard or tissue webs from at least one fibrous stock suspension.

2. Description of the Related Art

The production process of fibrous webs is substantially dependent on the stock consistency of the fibrous stock suspension being used. With increasing stock consistency of the used fibrous stock suspension a deteriorating formation of the fibrous web at the end of the process which can be described through the macroscopic and microscopic distribution of fibers and fillers can be observed. In order to achieve satisfactory results in regard to the quality of the fibrous web, fibrous stock suspensions having stock consistencies in the range of 0.8-1.2% are brought into the downstream forming units in the current conventional headboxes. If stock consistencies with higher values are used, a coarsely clouded formation inside the fibrous stock suspension is to be expected, already at the outlet of the jet from the headbox, due to heavy fiber flocculation. Measures are therefore to be taken to facilitate destruction of these flakes and timely fixing of the flow. In particular, an as flake-free fibrous stock suspension jet as possible is to be provided through the headbox at its outlet. Inside the turbulence generating device which is arranged before the nozzle, regions serving the de-flocculation and better fluidization for the fibrous stock suspension are therefore provided by different means in turbulence generating channels. Many times these are however not sufficient. The reason is the greatly reduced re-flocculation time with increased stock consistency. However, in order to achieve satisfactory formation parameters for the developing fibrous web, re-flocculation of the fibrous stock suspension is to be completely avoided if possible in the headbox after the most recent fluidization. This however, assumes appropriately short construction of units, which again are adverse to other requirements, in particular rigidity and reduction of the vibration tendency, as well as avoidance of hydraulic disturbances.

The problem of flake formation and its effect upon the quality of the developing fibrous web is described in publication EP 1 313 912 B1. As a solution, one design of a headbox with a modified turbulence generating device is suggested, whereby inside the turbulence generating device a fluidization is undertaken only once in one step in each turbulence generating channel of the turbulence generating device, thereby causing an acceleration of the flow and short dwell time of the fibrous stock suspension in the headbox. The level of fluidization can be maintained through the special design of the lamellas of the nozzle. For the fluidization, graduated changes of the cross sectional area of the individual turbulence generating channel of the turbulence generating device and lengths of the individual partial regions of the flow channels of the turbulence generating device forming the fluidization region are suggested which result in a length of the turbulence generating device in a range of 400 mm.

To improve the formation and the tear length properties of the developing fibrous web, a multitude of additional measures are already known which are characterized through a modification of the nozzle or the turbulence generating device.

Publication DE 101 06 684 A1 discloses one embodiment of a headbox with a specially designed lamella end for avoiding instabilities in the flow inside the nozzle and thereby a stimulation of vibration, whereby the lamella end is slanted on the side facing the nozzle wall and which, on the side facing away from the nozzle wall is provided with a structure. To influence the formation it is also known from publication DE 199 02 621 A1 to design the nozzle with different geometric regions to produce different flow cross sections inside the nozzle.

Publication WO 2008/077585 A1 discloses the promotion of the development of symmetric properties in a Z-direction over symmetrically designed headbox nozzles and the embodiment and dimensioning of same.

Measures for improving the transverse rigidity through alignment of the fibers in the region of the outlet from the nozzle are described in publication EP 1 022 378 A2. Design of the nozzle includes a region having a constant cross sectional reduction and an adjacent shorter region of constant cross sectional expansion.

In order to avoid bursting of the free jet during its exit from the nozzle, document DE 297 13 433 U1 discloses one embodiment of a headbox having a nozzle formed by machine-wide limiting areas of contact whereby at least one of the limiting surfaces is characterized by at least three segments of different angles of convergence.

Document DE 102 34 559 A1 discloses one embodiment of a headbox in a sheet forming system, wherein the nozzle is characterized by a length of ≧400 mm, whereby the turbulence block, which is formed by the turbulence generating device and which is located upstream from the nozzle, preferably is also within this length range.

All already known measures are however not suitable for bringing the dwell time of the individual fibrous stock suspension below its re-flocculation time, in particular at a higher stock consistency.

SUMMARY OF THE INVENTION

The current invention includes a method for operation of a sheet forming unit for a machine for producing fibrous webs, in particular paper, cardboard or tissue webs from at least one fibrous stock suspension, comprising a headbox and a forming unit arranged downstream from the headbox, whereby the at least one fibrous stock suspension is fed to the headbox over the machine width and by forming partial flows is led in a plurality of turbulence generating channels and to a nozzle from which the at least one fibrous stock suspension is applied or respectively delivered in the form of a free jet into the forming unit, in particular onto a clothing or between two clothings of the forming unit under definition of a line of impingement, whereby within an individual turbulence generating channel a pressure loss is set in the fibrous stock suspension.

The invention also relates to a sheet forming unit for a machine for producing fibrous webs, in particular paper, cardboard or tissue webs, comprising a headbox and a forming unit arranged downstream thereof, into which the fibrous stock suspension is supplied from the outlet gap of the headbox in the form of a free jet into a forming unit, in particular onto at least one clothing a the machine produces fibrous webs, in particular paper, cardboard or tissue webs so that the aforesaid disadvantages are avoided. In particular, re-flocculation of the fibrous suspension is avoided after the last fluidization inside the turbulence generating device prior to the nozzle until the outlet from the nozzle, and also after the nozzle and a fibrous stock suspension jet having high uniformity is supplied into the forming unit while avoiding strongly defined flake areas.

The present inventive method for operating a sheet forming unit for a machine for producing fibrous webs, in particular paper, cardboard or tissue webs from at least one fibrous stock suspension, includes a headbox and a forming unit located downstream from the headbox. The at least one fibrous stock suspension is fed across the machine width to the headbox, which is directed by the forming of partial flows through a plurality of turbulence generating channels of the turbulence generating device and is fed to a nozzle from where the at least one fibrous stock suspension is delivered in a free jet into the forming unit, particularly onto the clothing of the forming unit under definition of a line of impingement. Inside at least one individual turbulence generating channel a pressure loss is set in the fibrous stock suspension which is characterized by a final fluidization region of an individual turbulence generating channel upstream from the inlet into the nozzle, a pressure loss inside the fibrous stock suspension of ≧50 mbar, preferably ≧75 mbar, especially ≧100 mbar, most especially ≧150 mbar is produced. The fibrous stock suspension is led from this final fluidization region to the line of impingement so that its dwell time in the region defined from the final fluidization region as far as the line of impingement is ≧30 ms to ≦300 ms, preferably ≧50 ms to ≦200 ms, especially ≧80 ms to ≦200 ms.

A fluidization region is to be understood to be a region where the fibrous stock suspension, in particular the respective partial flow, is actively or passively influenced so that almost no fiber network is formed. The influence can hereby occur actively in regard to its effect through controllable elements, for example, static mixing devices, or passively through the geometric design of the flow path. The thereby determined generation of turbulences on the fibrous stock suspension result in disintegration of accumulations, in particular flakes. Viewed in a flow direction, the region may be limited locally on a line in cross machine direction, or can be designed progressing in flow direction.

The inventive solution offers the advantage of an expansion of the range of application of headboxes to fibrous stock suspensions with increased stock consistencies (fibers and fillers), preferably of approximately 1%, in particular in the range of ≧0.5% to ≦4%, preferably ≧1% to ≦3%, in particular ≧1% to ≦2.5% and at the same time optimized fiber and filler distribution or respectively formation at the discharge of them in a free jet into the forming unit by avoiding fiber and filler agglomeration. New development of flakes in the flow direction, as far as to the line of impingement of the fibrous stock suspension jet in the forming unit, which were disintegrated by the minimum pressure loss in the last fluidization region, can be safely avoided. The mobility of the fibers and thereby the level of fluidization is maintained due to the short dwell time until impingement onto the clothing of the downstream forming unit and in particular right through to the starting immobilization of the fibrous stock suspension.

Control of the fibrous stock suspension inside the turbulence generating device occurs preferably so that its dwell time between the last fluidization region of an individual turbulence generating channel and the outlet of the turbulence generating device is ≧10 ms to ≦100 ms. This mode of operation determines a short and compact design of a headbox, suitable for fibrous stock suspensions having a wide consistency range, as well as avoidance of re-flocculation based on the minimum distance from the final fluidization region and outlet from the nozzle and based on the minimum dwell time due on the acceleration resulting from the pressure loss.

The individual turbulence generating channel is designed and dimensioned so that, in the final fluidization region prior to the inlet into the nozzle, the pressure loss inside the partial flow guided in the region is ≧50 mbar, preferably ≧75 mbar, especially ≧100 mbar, most especially ≧150 mbar. The magnitude of the pressure loss offers the advantage of certain assurance of a high deflocculation level and high fiber mobility even at high consistencies which can be maintained over the aforementioned longitudinal regions in the flow direction as far as the outlet from the nozzle and further.

Regarding realization of the pressure loss inside the final fluidization region upstream from the nozzle in the flow direction a multitude of possibilities exist. Here, the final fluidization region viewed in the flow direction may be strongly limited locally or may be designed over a partial region of the turbulence generating channel of the turbulence generating device, extending in the flow direction. According to a first variation, the pressure loss may be generated passively, in the most simple case as a function of the geometry and/or dimensioning of the flow path in the individual turbulence generating channel of the turbulence generating device, or actively through the provision of additional devices and/or for supplies energy into the fibrous stock suspension inside the turbulence generating channel.

According to an especially preferred first variation of the present invention the pressure loss, in the final fluidization region of an individual turbulence generating channel before inlet into the nozzle, is produced by a graduated cross sectional change inside the turbulence generating channel. The cross sectional area of the individual turbulence generating channel of the turbulence generating device is described by a geometric form and dimension. The graduated change offers the advantage of easier generation of higher pressure losses in a locally, strictly limited area, inside the flow path by generating a very strong turbulence to break up flakes, whereby overall the fluidization is improved. The thereby adjusted high fiber mobility is then maintained through the short dwell time, according to the invention, as well as the short distance of the fluidization region from the outlet of the nozzle.

In an additional variation, the pressure loss prior to inlet into the nozzle is produced by a constant change of the cross sectional area of the individual turbulence generating channel, viewed in the flow direction.

The magnitude of the change of the cross sectional area, either the graduated or constant change from the minimum cross sectional area to the maximum cross sectional area, which can be described as the difference of the hydraulic diameters characterizing the cross sectional areas, is selected suitable for generating the required minimum pressure loss. Depending upon the characteristics of the fibrous stock suspension, which is to be used, the change of the cross sectional area in the fluidization region is selected and designed so that the change, in particular the level of progression characterizing the cross sectional change suits at least the medium fiber length of the utilized fibrous stock suspension. The fluidization level required for the short dwell time is thereby ensured.

According to an additional advantageous variation of the present invention the pressure loss can be brought about additionally or alternatively through a static mixing device provided in the fluidization region or by means of furnishing energy by producing the desired pressure loss in the fibrous stock suspension. These options offer the advantage of an easily realizable free adjustability of the pressure loss, independent of the geometry in the turbulence generating channel.

According to an especially advantageous embodiment of the present invention the fibrous stock suspension is led in the nozzle over a length in the range of 100 mm$\leqq l_D \leqq$500 mm, preferably 100 mm$\leqq l_D \leqq$400 mm, in particular 200 mm$\leqq l_D \leqq$400 mm, and from the final fluidization region inside the individual turbulence generating channel of the turbulence generating device upstream from the nozzle and the outlet from the turbulence generating device over a length of $\leqq$180 mm, preferably $\leqq$150 mm, especially $\leqq$120 mm, more especially $\leqq$100 mm. These measures permit a short and compact design of a headbox, suitable for fibrous stock suspensions having a wide consistency range, as well as avoidance of re-flocculation due to the minimum dwell time based on the minimum distance from the final fluidization region and outlet from the nozzle and from the acceleration resulting from the pressure loss.

To always assuredly avoid a segregation of fibers and fluid inside the final turbulence generating device before the nozzle, length $l_{TE}$ of the turbulence generating device for guidance of the fibrous stock suspension therein and of the individual turbulence generating channel is selected preferably to be in the range of 100 mm$\leqq l_{TE} \leqq$500 mm, preferably 100 mm$\leqq l_{TE} \leqq$400 mm, especially 150 mm$\leqq l_{TE} \leqq$300 mm.

Guidance of the respective partial flow of the fibrous stock suspension from the final fluidization region before the inlet into the nozzle occurs in an advantageous design through an additional region with a constant cross sectional change in the range of 50 mm to 100 mm.

Regarding the construction and design of the turbulence generating device of the present invention there are several options for which the above described conditions apply. The turbulence generating device can consist of a plurality of machine-wide turbulence generating channels which are arranged vertical to the flow direction above one another, or of a plurality of individually designed turbulence generating channels arranged in rows in cross machine direction and in columns arranged vertical to the cross machine direction. In one advantageous embodiment the number of rows of flow channels in the turbulence generating device is selected, such that the flow speed of the partial flow traveling in the narrowest cross section of such a turbulence generating channel of the turbulence generating device is between 5 m/s and 20 m/s, preferably between 7 m/s and 15 m/s. This design offers the advantage, together with the constructive characteristics, of a sensitive and effective fluidization.

The forming unit may be in the embodiment of a hybrid former, a gap former having two wire belts which form an inlet gap for the fibrous stock suspension, or a Fourdrinier wire former, having a wire belt onto whose surface the fibrous stock suspension is delivered by the headbox.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIGS. 4A1 and 4A2 show one arrangement of the turbulence generating channels for guidance of the partial flows;

FIGS. 4B1 and 4B2 show another arrangement of the turbulence generating channels for guidance of the partial flows.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 2:
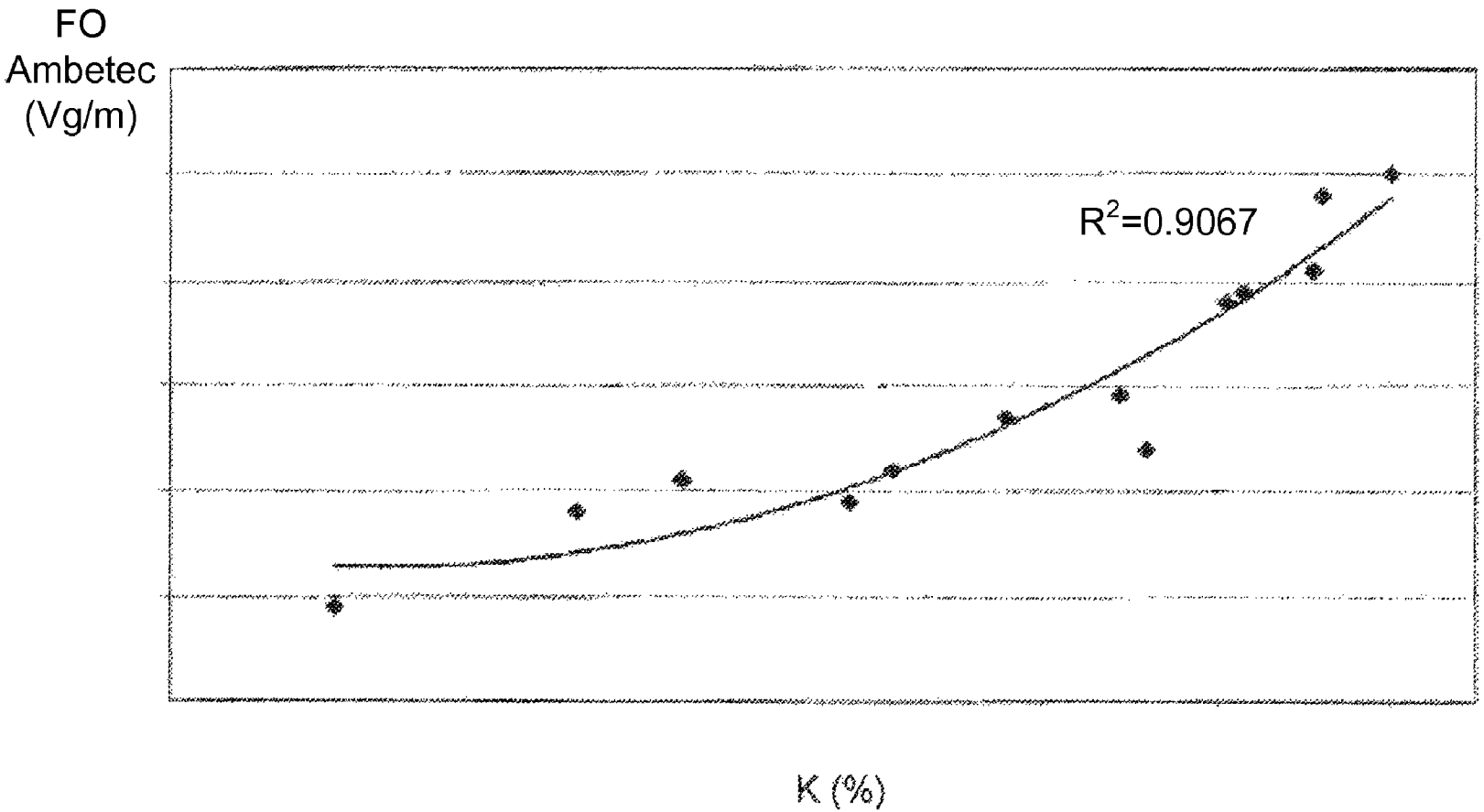
FIG. 2 illustrates with the assistance of a diagram the connection between stock consistency and formation.

Referring now to the drawings, and more particularly to FIG. 2 there is shown a schematically simplified illustration of a diagram of the influence of the level of stock consistency SK inside a fibrous stock suspension FS upon the formation. For this purpose the development of formation FO characterized by the Ambertec-value relative to consistency K of the fibrous suspension FS which is to be delivered by the headbox is plotted. From this the connection can be seen between high stock consistency SK and an uneven and coarsely clouded formation FO in regard to the arrangement of the fibers and fillers based on increased fiber flocculation, that is the tendency in conventional known headboxes toward larger flakes in the free jet F of fibrous stock FS suspension being delivered from the outlet gap of a headbox. It can also be seen that with fibrous stock suspensions with lower stock consistency the formation parameters are clearly improved. FIG. 2 only illustrates the basic connection between consistency of a fibrous stock suspension FS and the formation FO.

Figure 1A:
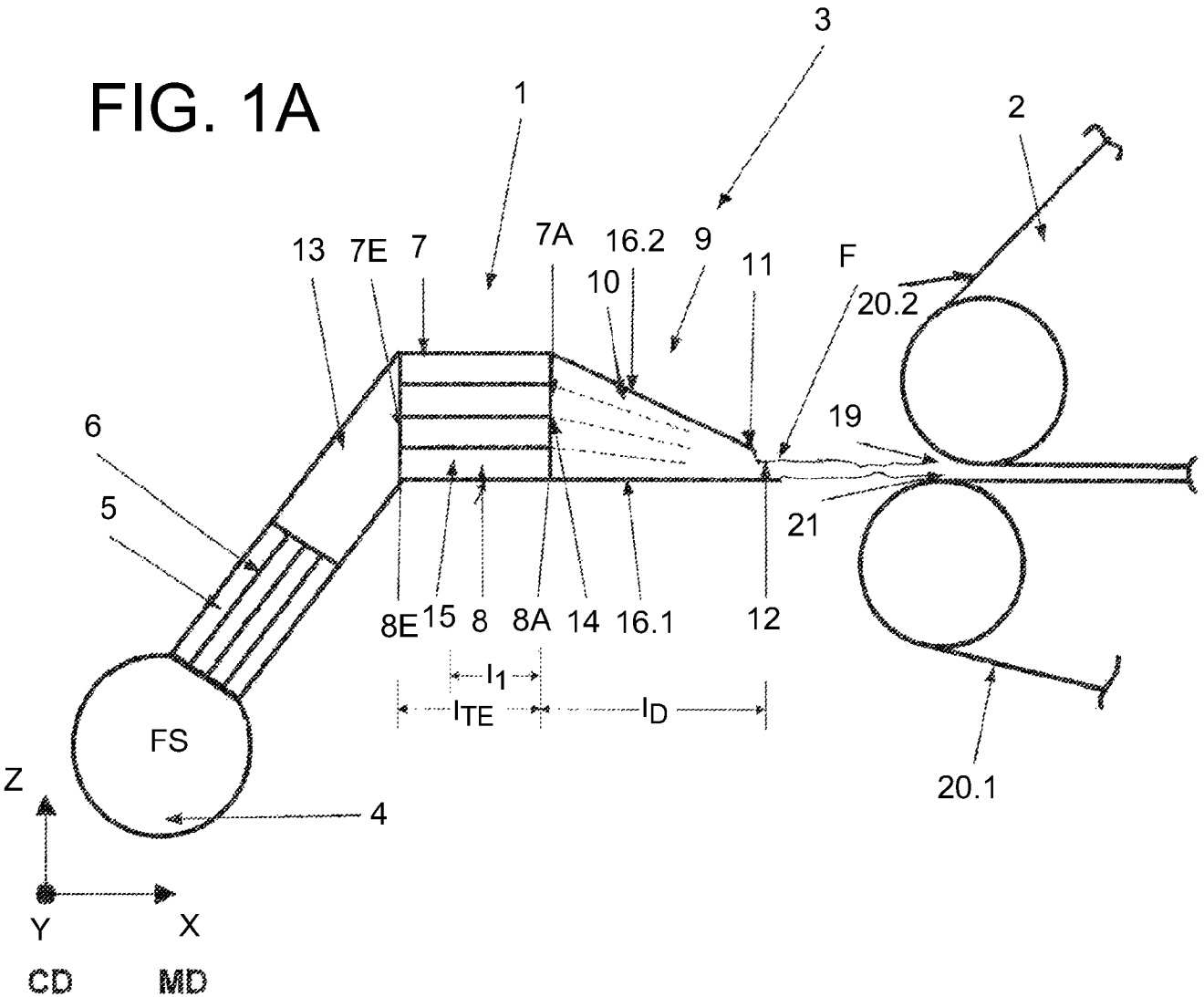
FIG. 1A illustrates a section of a machine for producing a material web having an embodiment of a sheet forming unit of the present invention.
Figure 1B:
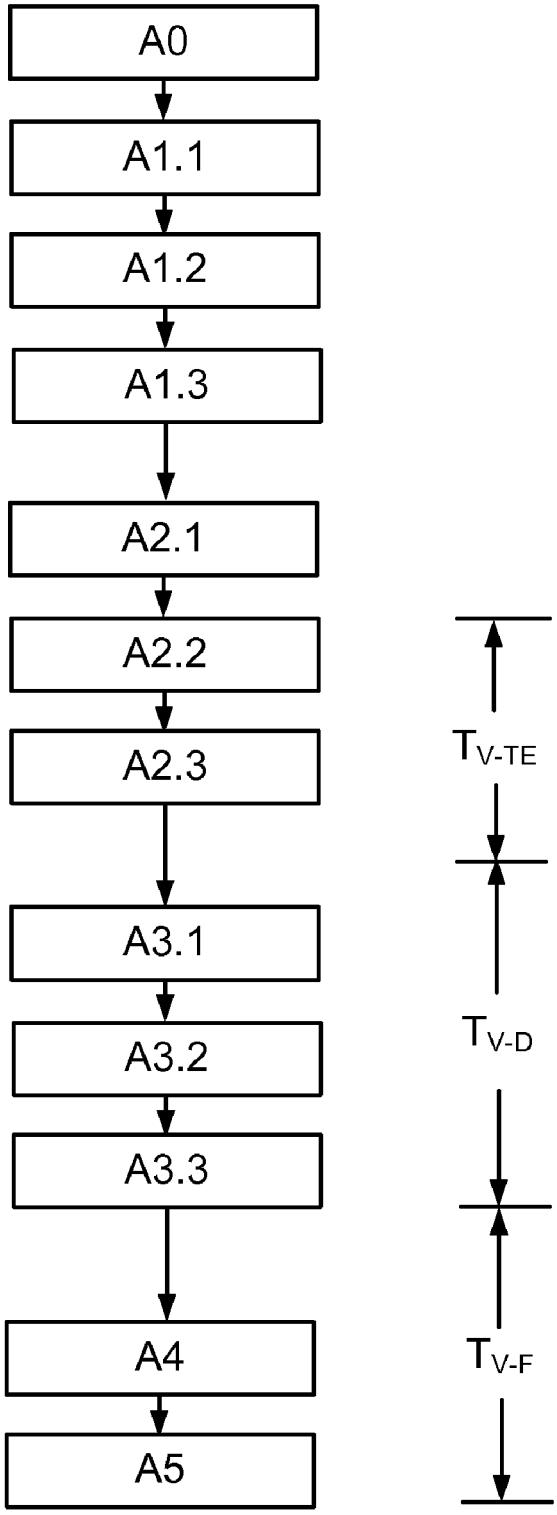
FIG. 1B is a process flow chart illustrating the sequence of the method for the inventive operation of the sheet forming unit of FIG. 1A.

Now additionally referring to FIG. 1A, in order to reduce, and if possible avoid, reflocculation, that is re-occurrence of flakes within the fibrous stock suspension FS before or during discharge from headbox 1, a method according to the present invention is utilized. This is illustrated in FIG. 1B in the form of a flow chart for the method of operation of a sheet forming unit 3 according to FIG. 1A suitable to implementation of the method. In explanation of the method, the design of a sheet forming unit 3 with suitability to implement the inventive method is first discussed.

Here, headbox 1 is located upstream from a forming unit 2, which together form sheet forming unit 3 for a machine for producing a material web, in particular a fibrous web in the form of a paper, cardboard or tissue web. Headbox 1 serves the machine-wide feeding of at least one fibrous stock suspension FS into forming unit 2. For clarification of the individual directions a coordination system is placed on sheet forming unit 3, whereby X-direction describes the longitudinal direction which is also referred to as machine direction MD and which coincides with the direction of travel of fibrous web F. Y-direction describes the direction transverse to the direction of travel of the fibrous web, in particular the width direction of the machine which is therefore also referred to as the cross machine direction CD, whereas Z-direction characterizes the height direction.

Headbox 1 includes a feeding device 4 through which the at least one fibrous stock suspension FS can be distributed across the entire width of headbox 1. In the most simple case this is in the embodiment of an element representing a distribution channel, in particular a distribution pipe extending in cross machine direction CD and which tapers in flow-through direction in cross machine direction. In the illustrated example fibrous stock suspension FS comes from feed device 4, for example, into a first turbulence generating device 5, having a plurality of turbulence generating elements. Turbulence generating device 5 may be of varying construction and in the simplest scenario is in the embodiment of flow channels, in particular turbulence generating channels 6 describing through-flow openings with an orifice plate or bundle of pipes. Viewed in a flow-through direction a space 13 is located adjacent to the first turbulence generating device 5 which is followed by an additional second turbulence generating device 7, having turbulence generating elements forming turbulence generating channels 8. Following second turbulence generating device 7, located at its outlet 7A is a nozzle 9, whereby a nozzle chamber 10 is formed which is capable of substantially accelerating the flow of fibrous stock suspension FS during operation and whereby fibrous stock suspension FS is delivered by way of an aperture 11 and through outlet gap 12 to forming unit 2 for the machine for producing a material web. Nozzle chamber 10 is limited by nozzle wall 16.1, and 16.2 in a directional plane vertical to machine direction MD and cross machine direction CD. Inside individual turbulence generating devices 5 and 7 the fibrous stock suspension FS is apportioned according to a pre-defined separation and travels on, distributed into partial flows. Turbulence generating devices 5 or respectively 7 include a plurality of turbulence generating channels 6, 8 extending in longitudinal direction of the machine, that is in machine direction MD and which are either machine-wide or are arranged parallel to each other in cross machine direction CD in rows and in vertical direction in columns, in other words vertical to a plane which can be described by the flow-through direction and cross machine direction CD.

Inside individual turbulence generating channel 8 at least one region representing a fluidization region 15 is provided, where a pressure loss is produced in the individual partial flow of fibrous stock suspension FS being guided in this region.

The second turbulence generating device 7, which is located upstream from nozzle 9 viewed in the direction of flow of fibrous stock suspension FS, and nozzle 9 are designed and dimensioned and located opposite forming unit 2 so that the dwell time $T_V$ of fibrous stock suspension FS when running through second turbulence generating device 7 until impingement onto a clothing 20.1 of forming unit 2 is ≧30 ms to ≦300 ms, preferably ≧50 ms to ≦200 ms, in particular ≧80 ms to ≦200 ms. This is achieved through appropriate matching of the geometry of second turbulence generating device 7, that is the element of headbox 1, which is located immediately prior to nozzle 9, and the design of nozzle 9. Second turbulence generating device 7 is arranged and dimensioned so that by way of it at least a pressure loss of ≧50 mbar, preferably ≧75 mbar, especially ≧100 mbar, most especially ≧150 mbar is produced in last fluidization region 15 before nozzle 9 within the partial flow guided in this region. Several options are conceivable here, whereby one differentiates between active and passive measures, in other words between a permanent adjustment of the achievable pressure loss or an open adjustability. As further explained below, the pressure loss can be achieved through the geometric design of individual turbulence generating channel 6, 8, in particular through local change of the cross sectional areas and/or arrangement of additional devices such as static mixing devices or an additional supply of energy into the individual partial flow.

The length of final turbulence generating device 7 upstream from nozzle 9, viewed in machine direction MD is indicated as 1 and is characterized by a length in the range of 100 mm≦$l_{TE}$≦500 mm, preferably 100 mm to ≦$l_{TE}$≦400 mm, especially 150 mm≦$l_{TE}$≦300 mm. Length $l_D$ of nozzle 9, measured from outlet 7A from turbulence generating device 7 to outlet gap 12 in machine direction MD is 100 mm≦lD≦500 mm, preferably 100 mm≦$l_D$≦400 mm, especially 200 mm≦$l_D$≦400 mm. The stability of the jet can hereby only be maintained if the damping effect of the fibers increases and length $l_D$ of nozzle 9 meets the following condition $$l_D \times SK \leqq 1000, \text{ preferably } \leqq 800, \text{ especially } \leqq 700,$$

whereby $l_D$ is consistent with the length of the nozzle in mm, and SK with the stock consistency in %.

An additional substantial geometric characteristic is length $l_1$ which describes the distance between final fluidization region 15 in turbulence generating device 7 located immediately before nozzle 9 and outlet 7A from turbulence generating device 7, which coincides with an inlet 14 into nozzle 9 and which is ≦180 mm, preferably ≦150 mm, especially ≦120 mm, more especially ≦100 mm.

An angle of convergence α is provided in the area of outlet gap 12 between individual nozzle walls 16.1, 16.2 which define nozzle chamber 10 and describes the angle between these in the area of the outlet gap 12 is selected within a range of 5° and 45°, preferably between 10° and 20°. With this geometric design of the combination of the characteristics, whereby essentially the length of nozzle $l_D$ and distance $l_1$ determine the dwell time $T_V$ and can be adjusted to a duration within a predetermined range and in particular to below the reflocculation time of fibrous stock suspension FS with higher stock consistency SK.

According to FIG. 1B delivery of fibrous stock suspension FS and machine-wide distribution in headbox 1 occurs in a first process step A0. In process step A1.1 fibrous stock suspension FS is fed, separated into partial flows into, for example, a first turbulence generating device 5 where it is subjected to a pressure loss according to A1.2 and is brought together again in a subsequent space 13 in A1.3. Prior to inlet into nozzle 9, fibrous suspension FS is potentially fed to an additional, in this instant a second turbulence generating device 7 by adding fluid and by separating into partial flows according to A2.1 and after these individually developed partial flows of fibrous stock suspension have traveled through the adjacent nozzle chamber 10 in A3.1 they are brought together again. A region 15 is provided inside second turbulence generating device 7 where in process step A2.2 a locally strong pressure reduction is produced inside turbulence generating channels 8 in the individual partial flow of fibrous stock suspension across the entire width of channel 8 in cross machine direction CD. The pressure reduction in machine direction MD occurs preferably graduated and the thereby set pressure loss is ≧50 mbar, preferably ≧75 mbar, especially ≧100 mbar, more especially ≧150 mbar. The individual partial flow experiences acceleration. In A2.3 the partial flow flows through turbulence generating channel 8, then further on to outlet 8A which coincides with inlet 14 into nozzle 9. The dwell time inside this region which is characterized by the final fluidization range 15 before nozzle 9 and inlet 14 into same is identified with $T_{V\text{-}TE}$. After the inlet according to A3.1 into nozzle 9 it is carried through to outlet gap 12 in A3.2 and is discharged at outlet gap 12 in process step A3.2. The dwell time between inlet 14 into nozzle 9 in A3.1 and discharge from outlet gap 12 in A3.3 is identified with $T_{V\text{-}D}$. Discharge occurs in the form of a free jet in A4 until impingement in forming unit 2 in A5. The dwell time between discharge of free jet F from outlet gap 12 of nozzle 9 and setting of the immobility point is identified with $T_{V\text{-}F}$.

The geometry of turbulence generating device 7 and nozzle 9 as well as the arrangement relative to forming unit 2 is such that the dwell time of fibrous stock suspension $T_V$ between final deflocculation in fluidization region 15 and line of impingement 21 after discharge of free jet F from outlet gap 12, which can be described as the sum of individual time durations $T_{V\text{-}TE}$, $T_{V\text{-}D}$ and $T_{V\text{-}F}$, is in the range of 30 ms to ≦300 ms, preferably 50 ms to 200 ms, especially preferably 80 ms to 200 ms.

Figure 3:
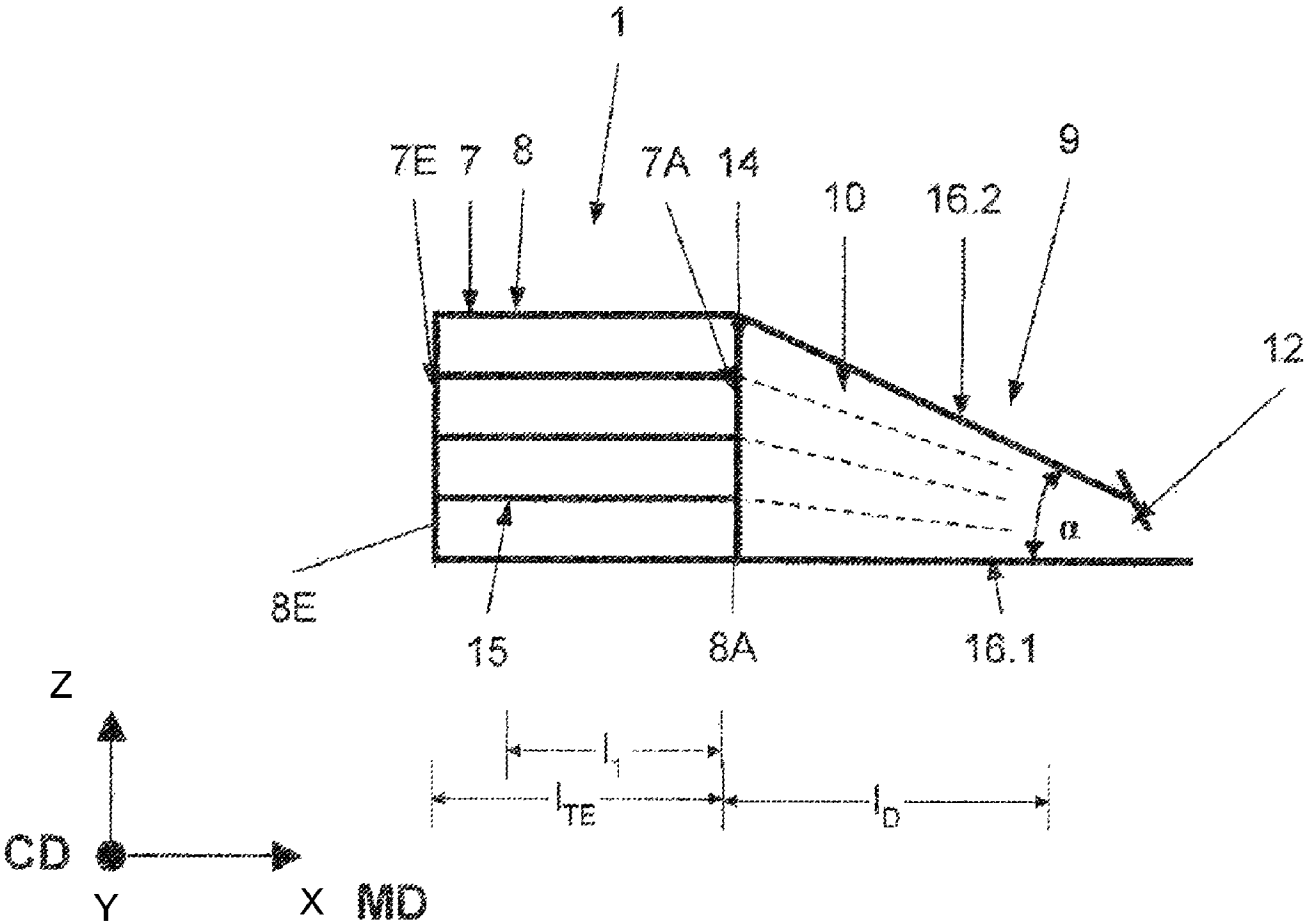
FIG. 3 shows a detailed section from an embodiment of a headbox of the present invention according to FIG. 1A.

FIG. 3 illustrates a detailed section of headbox 1 the components which are essential for producing the necessary geometric conditions on headbox 1 to implement the inventive process. Illustrated is nozzle 9 and the last region actively influencing the fibrous stock suspension FS which is located upstream, viewed in flow direction and which is formed by a turbulence generating device 7 and includes a fluidization region 15. Illustrated are the basic geometric dimensions $l_D$ in form of the length of nozzle, 11 as distance of the final fluidization region 15 within turbulence generating device 7 prior to inlet 14 into nozzle 9. The distance is hereby measured at the end of fluidization region 15. Fluidization region 15 may be planar, extending over a partial region of the flow path or may be linear in cross machine direction CD, that is locally strictly limited. Also illustrated is the angle of convergence a of nozzle 9 in the region of outlet gap 12 and length $l_{TE}$ of turbulence generating device 7, as well as length $l_1$ for identification of the distance between fluidization region 15 and inlet 14 into nozzle 9 in flow direction.

FIGS. 4A1, 4A2 and 4B1, 4B2 show a schematically greatly simplified illustration of advantageous designs of turbulence generating devices 7 for guidance of the partial flows. Turbulence generating device 7 which is utilized for the fluidization of fibrous stock suspension FS may take different forms. According to FIGS. 4A1 and 4A2 this can consist of a plurality of channels 8 in the embodiment of individual channels which are arranged in rows in cross machine direction CD and in columns in height direction. Individual channels 8, in this example 8.11 to 8.*nn*, can be in the form of pipes, square or rectangular profiles, etc. Moreover, integration of them into orifice plates is conceivable. FIG. 4A2 illustrates the arrangement in rows without offset relative to each other in cross machine direction CD. It is understood that also alternating offset of individual channels 8 between two rows relative to each other arranged vertically on top of one another is possible.

According to FIG. 4B2 it is moreover conceivable to design flow channels 8 as channels 8.1 to 8.*n* extending over the width in cross machine direction CD which are arranged on top of one another in height direction. These channels are identified here for example with 8.1 to 8.*n* and are illustrated in two views in FIGS. 4B1, 4B2. The coordinate system according to FIG. 1 was transferred for the purpose of directional allocation.

Figure 5:
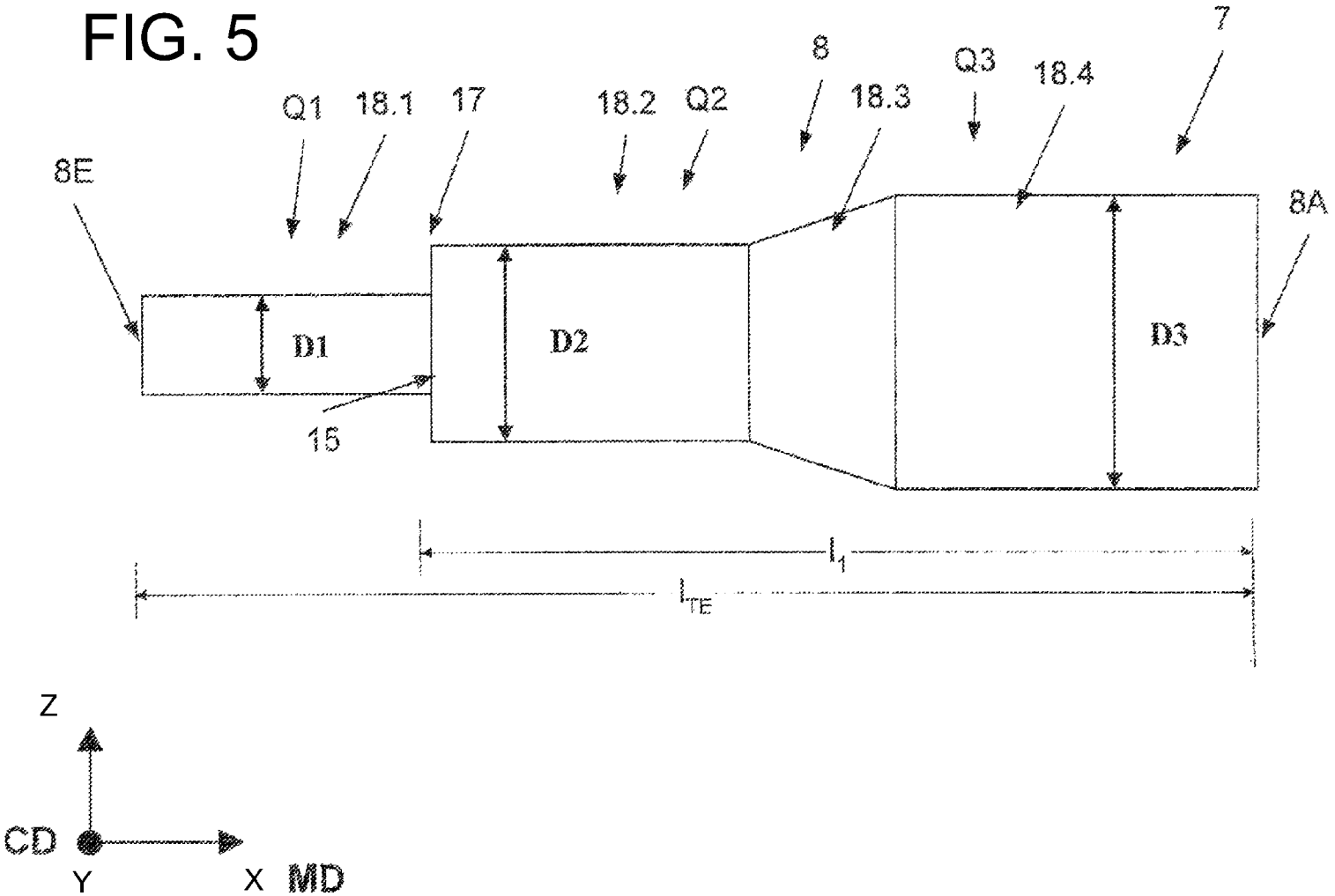
FIG. 5 shows an embodiment of a turbulence generating channel of the present invention.

All embodiments have a channel geometry property in common which provides an area characterized by a graduated cross sectional change 17, in particular by progression. An example of such a turbulence generating channel 8 is illustrated in FIG. 5. This view shows the extension in longitudinal direction that is in flow-through direction when installed in a machine for producing material webs. FIG. 5 clarifies the design of individual turbulence generating channel 8 in schematically greatly simplified depiction. In this example turbulence generating channel 8 is separated into a plurality of different partial regions 18.1 to 18.4. Inlet side 8E of turbulence generating channel 8 describes together with additional such channels inlet 7E into turbulence generating device 7. Outlet 8A corresponds to inlet 14 into nozzle 9. Between these, several partial regions 18.1 to 18.4 having different cross sectional areas Q1 to Q3 are arranged. The region of the final fluidization prior to the outlet into nozzle 9 is hereby realized through a graduated cross sectional change 17, in particular through a progression between two cross sectional areas Q1 and Q2. Here, turbulence generating channel 8 has a first partial region 18.1 which is characterized by a constant cross sectional area Q1 over its extension range in the flow-through direction, which is described by a hydraulic diameter $d_{hydr}$, in the illustrated example by a circular cross section through a diameter D1. Second partial region 18.2 which is located adjacent in flow-through direction between inlet 8E to outlet 8A is also characterized over the extension of the partial region 18.2 in flow direction, through a constant cross section which can be described by a diameter D2. The second partial region is followed by a transition area 18.3 which permits a constant, that is continuous transition to a third partial region 18.4 which is characterized by a cross sectional area Q3 which can be described by a diameter D3.

The design of the progression that is the cross sectional change 17 between cross sectional areas Q1 to Q2 which is characterized advantageously by a diameter change D2/D1 of the geometry describing the partial regions of turbulence generating channel 8 occurs so that a pressure loss between the first partial region 18.1 and the second partial region 18.2 of greater than 50 mbar, preferably 75 mbar, especially preferred greater than 100 mbar is produced. It is decisive however, that length $l_1$ of second partial region 18.2 and third partial region 18.4 under consideration of transitional region 18.3 which characterizes the distance from fluidization region 15 formed by progression region 18.3 to outlet 8A from turbulence generating channel 8 or respectively from turbulence generating device 7, must be at least ≦180 mm, preferably ≦150 mm, especially ≦120 mm, more especially ≦100 mm in the preferred design. Length $l_{TE}$ of individual turbulence generating channel 8 is between 100 mm≦$l_{TE}$≦500 mm, preferably 100 mm≦$l_{TE}$≦400 mm, especially between 150 mm≦$l_{TE}$≦300 mm.

If cross sectional areas Q1, Q2 and Q3 cannot be described by a diameter D1, D2 and D3, in other words, in the case of other cross sectional geometries, then the hydraulic diameter $D_{hydr}=4\cdot Q/U$, with Q=cross sectional area and U=circumference is used.

According to a particularly advantageous design the final progression which is necessary for fluidization and which is located before nozzle 9 should be at least in the range of the medium fiber length of the utilized fibrous stock suspension FS, that is $(D2\text{-}D1)/2 \geqq l_{Fmittel}$ whereby here the diameter with a circular cross section is formulated, otherwise the respective hydraulic diameter $d_{hydr}$.

Since after fluidization, that is after the last progression viewed in the flow direction the formed flake size inside fibrous stock suspension FS depends on the available space, or in other words, on the cross sectional area Q. The largest hydraulic diameter $d_{hydr\text{-}8}$ inside turbulence generating channel 8 should be in the range of 5 mm≦$d_{hydr}$≦25 mm, preferably 5 mm≦$d_{hydr}$≦20 mm, especially preferred 10 mm≦$d_{hydr}$≦20 mm, and because of the fiber wipe formation the hydraulic diameter $d_{hydr\text{-}8E}$ in the area of inlet 8E on turbulence generating channel 8 should be selected preferably in the range of 8 mm≦$d_{hydr\text{-}8E}$≦20 mm, preferably 10 mm≦$d_{hydr\text{-}8E}$≦20 mm, especially preferably 10 mm≦$d_{hydr\text{-}8E}$≦15 mm.

The number of rows, in other words, the number of flow channels 8 within one column should be selected so that the flow speed in the narrowest cross section is between 5 m/s and 20 m/s, preferably between 7 m/s and 15 m/s.

A headbox 1 of this type can be further modified as desired. There may be headboxes equipped with lamellas and/or with dilution fiber technology, meaning with at least one metering device for adding a fluid into flow channels 8.

The inventive method can moreover be used in combination with randomly designed forming units 2, in particular a Fourdrinier wire, a Hybrid Former and a Twin Wire Former. The example illustrated in FIG. 1A represents an advantageous design in combination with a Gap Former whereby the free jet F is directed into a gap 19 between clothing 20.1, 20.2 which is supported by two rollers. It is however not limited to this.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Headbox
2 Forming unit
3 Sheet forming unit
4 Feed device
5 Turbulence generating device
6 Turbulence generating channel
7 Turbulence generating device
7E Inlet into turbulence generating device
7A Outlet from turbulence generating device
8 Turbulence generating channel
8.1-8.2, 8.11-8.*n* Turbulence generating channel
8E Inlet into turbulence generating channel
8A Outlet from turbulence generating channel
9 Nozzle
10 Nozzle chamber
11 Aperture
12 Outlet gap
13 Space
14 Inlet
15 Region
16.1 Nozzle wall
16.2 Nozzle wall
17 Cross sectional change
18.1 First partial region
18.2 Second partial region
18.3 Transitional region
18.4 Third partial region
19 Gap
20.1, 20.2 Wire belt
21 Line of impingement
A0-A5 Process steps
CD Cross machine direction
D1 Diameter of first partial region
D2 Diameter of second partial region
D3 Diameter of third partial region
$d_{hydr}$ Hydraulic diameter
$d_{hydr\text{-}8}$ Hydraulic diameter of turbulence generating channel
$d_{hydr\text{-}8E}$ Hydraulic diameter at inlet into turbulence generating channel
F Free jet
FS Fibrous stock suspension
$l_D$ Length of nozzle
$l_{Fmittel}$ Medium fiber length
$l_{TE}$ Length of turbulence generating device
$l_1$ Length of distance between progression and inlet into nozzle
MD Machine direction
FO Formation parameter
K Consistency
$T_V$ Dwell time
$T_{V\text{-}TE}$ Dwell time, turbulence generating device after fluidization
$T_{V\text{-}D}$ Dwell time, nozzle
$T_{V\text{-}F}$ Dwell time, free jet
Q1 Cross sectional area of first partial region
Q2 Cross sectional area of second partial region
Q3 Cross sectional area of third partial region
Δp Pressure loss
α Nozzle angle of convergence

What is claimed is:

1. A method for operating a sheet forming unit for a machine for producing fibrous webs, in particular paper, cardboard or tissue webs from at least one fibrous stock suspension, the machine including a headbox and a forming unit arranged downstream from the headbox, comprising the steps of:

feeding the at least one fibrous stock suspension to the headbox over a machine width of the machine;

forming partial flows of the at least one fibrous stock suspension as the at least one fibrous stock suspension is led into a plurality of turbulence generating channels and to a nozzle from which the at least one fibrous stock suspension is applied or respectively delivered in the form of a free jet onto a clothing or between two clothings of the forming unit defining a line of impingement, whereby within at least one of said turbulence generating channels a pressure loss (Δp) is set in the at least one fibrous stock suspension;

producing said pressure loss Δp in a final fluidization region of said at least one turbulence generating channel upstream from an inlet into said nozzle of ≧50 mbar; and leading the at least one fibrous stock suspension from said final fluidization region to said line of impingement so that a dwell time ($T_V$) in a region defined from said final fluidization region to said line of impingement is ≧30 ms to ≦300 ms.

2. The method of claim 1, wherein said pressure loss Δp is at least one of ≧75 mbar, ≧100 mbar, and ≧150 mbar.

3. The method of claim 1, wherein said dwell time $T_V$ is in a range of at least one of ≧50 ms to ≦200 ms and ≧80 ms to ≦200 ms.

4. The method of claim 1, further comprising the step of controlling said at least one fibrous stock suspension inside a turbulence generating device occurs such that a dwell time (TV-TE) of said at least one fibrous stock suspension between said last fluidization region of said at least one turbulence generating channel and an outlet of said turbulence generating device is ≧10ms to ≦100 ms.

5. The method of claim 4, wherein said pressure loss Δp in said final fluidization region of said at least one turbulence generating channel before said inlet into said nozzle is produced by a graduated cross sectional change inside said at least one turbulence generating channel.

6. The method of claim 4, wherein said pressure loss Δp in said final fluidization region of said at least one turbulence generating channel before said inlet into said nozzle is produced by a constant cross sectional change inside said at least one turbulence generating channel.

7. The method of claim 4, wherein said pressure loss Δp in said final fluidization region of said at least one turbulence generating channel before said inlet into said nozzle is produced by a cross sectional change inside said at least one turbulence generating channel, the change of the cross sectional area in fluidization region, in particular the level of the progression characterizing the magnitude of the cross sectional change is selected to suit at least the medium fiber length ($l_{Fmittel}$) of said at least one fibrous stock suspension.

8. The method of claim 7, wherein said at least one fibrous stock suspension inside said at least one turbulence generating channel after said last fluidization region before said inlet into said nozzle is led over at least one additional partial region with a constant cross section change.

9. The method of claim 7, wherein said pressure loss Δp in said final fluidization region of said at least one turbulence generating channel before said inlet of said nozzle is produced by furnishing energy into said at least one fibrous stock suspension in said at least one turbulence generating channel.

10. The method of claim 1, wherein a fibrous stock suspension having an overall stock consistency in the range of ≧0.5% to ≦4% is utilized as said at least one fibrous stock suspension.

11. The method of claim 10, wherein said stock consistency is in a range of at least one of ≧1% to ≦3% and ≧1% to ≦2.5%.

12. The method of claim 1, wherein said at least one fibrous stock suspension is directed in said nozzle over a length ($l_D$) in a range of 100 mm ≦$l_D$≦500 mm.

13. The method of claim 12, wherein said length $l_D$ is in a range of at least one of 100 mm≦$l_D$≦400 mm and 200 mm ≦$l_D$≦400 mm.

14. The method of claim 1, wherein a distance ($l_1$) between said last fluidization region before said nozzle and said inlet into said nozzle is selected to be ≦180 mm.

15. The method of claim 14, wherein said distance $l_1$ is at least one of ≦150 mm and ≦120 mm.

16. The method of claim 1, wherein said at least one fibrous stock suspension inside said at least one turbulence generating channel is led over a length ($l_{TE}$) viewed in a flow direction in a range of 100 mm≦$l_{TE}$≦500 mm.

17. The method of claim 16, wherein said length ($l_{TE}$) is in a range of at least one of 100 mm≦$l_{TE}$≦400 mm and 150 mm≦$l_{TE}$≦300 mm.

* * * * *

UNITED STATES PATENT AND TRADEMARK OFFICE

CERTIFICATE OF CORRECTION

PATENT NO. : 8,382,955 B2
APPLICATION NO. : 13/370697
DATED : February 26, 2013
INVENTOR(S) : Markus Häussler et al.

It is certified that error appears in the above-identified patent and that said Letters Patent is hereby corrected as shown below:

In the Specification

COLUMN 8

At line 6, please delete "indicated as 1", and substitute therefore --indicated as $1_{TE}$--.

COLUMN 9

At line 31, please delete "gence a", and substitute therefore --gence α--.

Signed and Sealed this
Ninth Day of December, 2014

Michelle K. Lee

Michelle K. Lee
*Deputy Director of the United States Patent and Trademark Office*